United States Patent [19]

Double et al.

[11] Patent Number: 4,804,508

[45] Date of Patent: Feb. 14, 1989

[54] PROCESS FOR SPINNING POLYAMIDE AT HIGH SPEED

[75] Inventors: Jean-Pierre Double, Franchevile; Cecile Lecluse, Lyons, both of France

[73] Assignee: Rhone-Poulenc Fibres, Lyons, France

[21] Appl. No.: 75,271

[22] Filed: Jul. 20, 1987

Related U.S. Application Data

[63] Continuation of Ser. No. 794,607, Nov. 6, 1985, abandoned, which is a continuation of Ser. No. 580,264, Feb. 15, 1984, abandoned.

[30] Foreign Application Priority Data

Feb. 16, 1983 [FR] France ..... 83 02627

[51] Int. Cl.[4] ..... D01D 5/088; D01D 5/12; D01F 6/60

[52] U.S. Cl. ..... 264/103; 264/211.14; 264/210.2; 264/290.5; 264/290.7; 264/210.8; 264/130

[58] Field of Search ..... 264/103, 290.7, 210.8, 264/DIG. 75, 210.2, 290.5, 130; 425/725

[56] References Cited

U.S. PATENT DOCUMENTS

| | | | |
|---|---|---|---|
| 2,604,667 | 7/1952 | Hebeler | 264/210.8 |
| 3,596,319 | 8/1971 | McKenica | 425/725 |
| 3,988,086 | 10/1976 | Marshall et al. | 264/290.7 |
| 4,049,763 | 9/1977 | Mineo et al. | 264/176 F |
| 4,247,505 | 1/1981 | Jackson | 264/176 F |
| 4,318,676 | 3/1982 | Gerking et al. | 264/176 F |
| 4,338,276 | 7/1982 | Can | 264/176 F |

FOREIGN PATENT DOCUMENTS

| | | | |
|---|---|---|---|
| 0118375 | 9/1984 | European Pat. Off. | 264/176 F |
| 2615246 | 10/1977 | Fed. Rep. of Germany . | |
| 0976505 | 3/1951 | France . | |
| 2277913 | 7/1975 | France . | |
| 0129271 | 1/1978 | German Democratic Rep. | 264/176 F |
| 4537167 | 11/1970 | Japan | 264/176 F |
| 7205215 | 2/1972 | Japan | 264/290.7 |
| 0012327 | 1/1977 | Japan | 264/103 |
| 59-66507 | 4/1984 | Japan | 264/176 F |
| 0730247 | 5/1955 | United Kingdom | 264/176 F |

OTHER PUBLICATIONS

Kirk-Othmer, "Encyclopedia of Chemical Technology", 3rd ed., vol. 18, 1982, Wiley & Sons, pp. 382-385.

*Primary Examiner*—Jan H. Silbaugh
*Assistant Examiner*—Hubert C. Lorin
*Attorney, Agent, or Firm*—Stevens, Davis, Miller & Mosher

[57] ABSTRACT

A simplified process is provided for spinning polyamide at high speed, with direct take-up on the winder of the filaments produced in which the filaments are cooled transversely under the die by means of a gaseous fluid having a moisture content of approximately 75%, brought together and oiled simultaneously at a distance of between 50 and 80 cm, preferably between 55 and 70 cm, from the die and then wound directly at a speed of at least 5,000 m/min, the maximum distance between the die and the point of contact of the filaments on the bobbin being between 130 cm and 200 cm. The yarns obtained can be used as such or may be textured according to any known means.

3 Claims, No Drawings

PROCESS FOR SPINNING POLYAMIDE AT HIGH SPEED

This application is a continuation of application Ser. No. 794,607, filed Nov. 6, 1985, now abandoned, which is a continuation of Ser. No. 580,264, filed Feb. 15, 1984, now abandoned.

The present invention relates to the production of filaments based on polyamides, at high speed, according to a simplified and compact process.

According to French Pat. No. 976,505, it is already very widely known to spin fibres based on polyamide, in particular polycaprolactam, at a speed which permits the fibres to be oriented at the same time, this speed being greater than 4,500 m/min. However, such a patent provides no precise information about carrying out the process.

It is also known, according to French Pat. No. 2,277,913, to spin synthetic polymers and to wind them directly, at speeds of 2,500–5,000 m/min, the filaments being converged at a distance from the die which, in all the examples, is at least 1.25 m, the total distance between the die and the winder being approximately 4 meters. Also according to the examples, this patent applies essentially to polyester-based yarns.

Moreover, it is also known, according to German Application No. 2,615,246, to spin thermoplastic polymers, at relatively high speeds of 3,000 to 6,000 m/min but by means of a special arrangement according to which the cooling takes place in a zone closed at the base by a wall which permits only the yarns to pass. Moreover, the single example of this patent relates to the spinning of polyester at a speed of 3,500 m/min, the cooling zone extending over a distance of 1.80 m, and the length between die and winding being greater than 4.80 m.

It has now been found that it is possible to obtain polyamide-based yarns at high speed and with a reduced space requirement.

The present invention relates more particularly to a simplified process for spinning, at high speed, polyamide-based filaments with direct take-up of the latter on the winder. In the new process after extrusion, the filaments are:

cooled at the exit of the die with a gaseous fluid having a moisture content which is conveniently about 75%, blown transversely to the bundle of filament;

brought together and oiled simultaneously at a convergence point situated at a distance of 50 to 80 cm from the die; and wound on a bobbin at a speed equal to or greater than 4,000 m/min, the maximum distance between the die and the point of deposition of the filaments on the winding bobbin being 130 to 200 cm.

Preferably, the distance between the die and the point of convergence is between 55 and 70 cm and the speed of winding is generally greater than 4,500 or 5,000 m/min.

After the convergence, the filaments may be interlaced to give cohesion to the yarns and to facilitate their subsequent take-up for some applications.

The process of the present invention applies very particularly to the spinning of polyamides, preferably polyhexamethylene adipamide or copolyamides containing at least 85% of hexamethylene adipamide units and up to 15% of other units obtained by replacing, for example, the original adipic acid with another diacid such as terephthalic, sebacic, and the like, or by replacing both monomers with, for example, caprolactam.

The starting polyamides may also contain additives such as matting agents, light stabilisers, heat stabilisers, antioxidants, additives intended to reduce the formation of static charges or to modify dye affinity, and the like.

The distance between the die and the point of convergence, which is between 50 and 80 cm, preferably between 55 and 70 cm, depends on a number of factors, in particular the fibre count, the speed of spinning, the blowing conditions such as the air speed, and to a lesser extent on the moisture content and the temperature.

The speed of spinning, which is the speed of the yarns in the solid state, that is also to say the speed of winding, is equal to or greater than 4,000 m/min, more generally greater than 5,000 m/min and can easily reach 6,000 m/min or even more. It depends essentially on the technical components permitting the process to be carried out industrially, in particular the means of winding. The maximum total height between the die and the point of deposition on the bobbin can vary between 130 and 200 cm, that is to say that the process according to the invention can be carried out industrially on a single floor, in contrast to the conventional processes, which permits the operator to have access to the die as easily as to the winder; the industrial economic benefit, as much from the point of view of energy as from that of conditioning and handling, is therefore obvious and incommensurate with the conventional processes.

Within the limits of the definition, the distance between the point of convergence and the winding is not a critical value; it depends only on the devices provided between these two points, such as, for example, an interlacing nozzle, and the height of triangulation.

To reduce the overall dimensions of industrial spinning machines, it is also possible to provide several dies mounted together in parallel, with several yarns converging at the same level and a number of winders offset vertically or horizontally relative to each other, the yarns then forming a small angle relative to the spinning, to be capable of being wound.

Relative to a conventional process, the process according to the present invention offers the following advantages:

it employs the same technical components but in a clearly more limited volume, which naturally results in savings in investment, operation and manpower, it makes it possible to work at higher speeds without the need for the use of a tension-regulating device such as intermediate rollers or sophisticated winder.

In fact, with such a process, it is possible to obtain lower tensions under the convergence, which permits, for example, the yarns to be interlaced and then would at limited tensions, in general not greater than 0.20 cN/dtex, to be able to obtain acceptable windings.

The yarns produced in this way have mechanical properties and shrinkage properties which are close to those of yarns obtained at speeds comparable to those of the high-speed processes employed industrially at the present time. Like the latter, the yarns according to the invention are very uniform (count, mechanical and shrinkage properties, dyeing affinity). Furthermore, they have good cleanness. They can be employed as such, for producing woven articles such as lining, protective clothing, or knitted articles (for example, chain knitting), or they can be subsequently textured according to any process employed industrially at the present time. They have, above all, a good uniformity of count and a level of cohesion which is suitable for their subsequent use.

In the examples which follow, the relative viscosity of the polyamide is determined on a solution at a concentration of 8.4% by weight per volume in 90% strength formic acid.

The values of tenacity, elongation and Young's modulus are determined by means of an apparatus known in commerce under the trade name INSTRON 1122, according to French Standard NF G 07-003.

The measurement of shrinkage in boiling water is carried out on a doubled yarn knotted at its end, which is subjected to a standard pre-tension of 50 mg/dtex. The length $L_o$ of the doubled yarn is read at the level of the knot before treatment, on a graduated scale, then the yarn is immersed for 15 minutes in the free state in boiling water, then placed for 10 minutes in the free state in an oven at 80° C. and left for at least 60 minutes in the free state in a standard atmosphere (65% RH and 20° C.±2). The length $L_1$ of the doubled yarn is read.

$$BW \text{ shrinkage} = \frac{L_o - L_1}{L_o}$$

The measurement of the shrinkage under dry heat at 160° C. (dry air) is also carried out on a doubled yarn knotted at its end using the same pre-tension as above. The new length $L_o$ is read.

Then the yarn is treated for 30 minutes in a ventilated oven at 160° C. and is left for at least 60 minutes in the free state in a standard atmosphere. The new length $L_1$ is read.

$$DA \text{ shrinkage } 160° = \frac{L_o - L_1}{L_o}$$

The mean linear non-uniformity U% expresses the mass variations along the controlled yarn. These mass variations are distributed on either side of the mean of the mass per unit length and are measured as a function of this mean, using a "USTER, type B-11" uniformity meter and an "USTER, type L-13" intergrator which permits the value of the mean non-uniformity to be integrated as a percentage.

The number of defects is measured using a commercial apparatus known as a "Creel Mirror". The number of defects visible to the naked eye over a given length is counted and the number of defects per 1,000 km of yarn is reported.

The cohesion factor, measured with an apparatus known in commerce under the trade name "Rotschild" (NPT-Type 2040), consists in detecting automatically the distance between points of interlacing by means of a needle which is placed between the filaments of a yarn in motion and which is retracted as soon as it encounters a point of resistance.

The cohesion factor is expressed by the ratio $$f = \frac{100}{d}$$

d being the average distance in cm between points of interlacing, calculated for at least 100 points.

The properties of hose are measured with a dynamometer for hosiery, using the following method: Each end of the specimen (the length, or the briefs) is clamped in the dynamometer jaws. The length $L_o$ of the specimen is measured without pre-tensioning. A load is applied gradually up to a predetermined value which is a function of the yarn count and the number of meshes. The force/elongation curve is thus recorded and the specimen length LM is determined under the predetermined load. The load is removed gradually and the regain curve is recorded. The length LR which is the length of the specimen at the time when the force is reduced to zero ($LR > L_o$) is determined. The cycle is carried out a second time. $L_{o1}$, the new length of the specimen without pretensioning, is determined ($L_{o1} > L_o$, but $L_{o1} < LR$ because of a relaxation phenomenon). A second force/elongation curve is recorded which, for the predetermined load, again gives the length LM. The load is reduced gradually and the regain curve is recorded. The length $LR_1$ is determined at the time when the force is reduced to zero, $LR_1$ being found in practice to be equal to LR. The elasticity, the elastic recovery and the deformation are calculated using the following formulae:

$$\text{elasticity} = \frac{LM - L_o}{L_o} \times 100$$

$$\text{elastic recovery} = \frac{LM - L_{o1}}{LM} \times 100$$

$$\text{deformation} = \frac{LR - L_o}{L_o} \times 100$$

The following examples illustrate the present Application without restricting it.

EXAMPLES 1 TO 3

A polyhexamethylene adipamide matted with 0.3% by weight of titanium oxide, protected against the light with 7 ppm of manganese and having a relative viscosity of 39, measured on an 8.4% solution in 90% strength formic acid, is prepared.

The polymer is melted at 291° C. and extruded through a die having 2 series of 33 orifices 0.23 mm in diameter; the polymer throughput is 87 g/min.

At the exit of the die, the filaments are cooled transversely with moist air (75% moisture) by means of a blower emitting air at 50 m/min, blown transversely, and are collected into 2 yarns corresponding to the 2 series of orifices.

The other test conditions are collated in table I.

TABLE I

| Examples | 1 | 2 | 3 |
|---|---|---|---|
| Blower: air speed m/min | 50 | 50 | 50 |
| Distance die/convergence (cm) | 59.5 | 59.5 | 59.5 |
| Distance convergence/winder (cm) | 116.5 | 116.5 | 116.5 |
| Distance die/winder (cm) | 177 | 177 | 177 |
| Interlacing by nozzle before the winder | yes | no | yes |
| Air pressure in the nozzle (Pa) | $4 \cdot 10^5$ | — | $2 \cdot 10^5$ |
| Tension under convergence | | | |
| (cN) | 10 | 9.5 | 10.5 |
| (cN/dtex) | (0.13) | (0.13) | (0.14) |
| Tension before nozzle | | | |
| (cN) | 11 | 10.5 | 11.5 |
| (cN/dtex) | (0.15) | (0.14) | (0.15) |
| Winding speed m/min | 5,800 | 5,800 | 5,800 |

The yarns thus produced have the properties collated in table II.

TABLE II

| Examples | 1 | 2 | 3 |
|---|---|---|---|
| Count (dtex) | 75 | 74 | 75 |
| Breaking force (cN) | 240 | 265 | 261 |
| Tenacity (cN/tex) | 33 | 36 | 35 |
| Elongation (%) | 54 | 59 | 59 |
| BW shrinkage (%) | 4.5 | 4.2 | 4.2 |
| DA shrinkage 160° C. (%) | 1.8 | 1.5 | 1.1 |
| U % | 0.65 | 0.52 | 0.58 |
| Young's modulus (cN/tex) | 206 | 203 | 198 |
| Cohesion factor | 21 | 1 | 11 |
| Number of broken fibres/1,000 km | 0 | 0 | / |

EXAMPLES 4 AND 5

A polymer which is identical to that prepared according to example 1 is prepared and spun through a die comprising two series of 7 orifices 0.34 mm is diameter, to obtain two yarns of 7 filaments.

Depending on the desired count, the throughput is determined as a function of the yarn take-up speed (winding speed).

The operating conditions are as follows:

TABLE III

| Examples | (4) | (5) |
|---|---|---|
| Blower: air speed (m/min.) | 50 | 50 |
| Distance die/convergence (cm) | 60 | 60 |
| Distance convergence/winder (cm) | 130 | 130 |
| Distance die/winder (cm) | 190 | 190 |
| Interlacing by nozzle before winder | yes | yes |
| Pressure in the interlacing nozzle (Pa) | $3 \cdot 10^5$ | $3 \cdot 10^5$ |
| Tension at the triangulation | | |
| (cN) | 2.5 | 3.5 |
| (cN/dtex) | (0.11) | (0.16) |
| Winding speed (m/min) | 5,640 | 6,000 |

The properties of the yarns obtained are given in table IV.

TABLE IV

| Examples | (4) | (5) |
|---|---|---|
| Theoretical count (dtex) | 22 | 22 |
| Measured count (dtex) | 21.5 | 21.3 |
| Breaking force (cN) | 84.9 | 81.1 |
| Tenacity (cN/tex) | 39.6 | 37.8 |
| Elongation at the break (%) | 65.2 | 60.2 |
| U % | 0.55 | 0.60 |
| BW shrinkage (%) | 3.3 | 3.7 |
| Cohesion factor | 5.7 | 5.4 |

The yarn obtained in test 4 was textured in conditions similar to those employed for a preoriented polyamide yarn (POY) obtained industrially.

The texturing conditions are collated in table V.

TABLE V

| Examples | Yarn according to the invention | Comparative POY yarn |
|---|---|---|
| Stretch ratio | 1.24 | 1.30 |
| Spindle type | positorq II | positorq II |
| Number of discs | 1 + 4 + 1 | 1 + 4 + 1 |
| DY | 2.03 | 1.93 |
| Oven temperature (°C.) | 215 | 215 |
| Yarn winding speed (m/min) | 850 | 850 |

DY: ratio of the linear speed of disc friction to the linear speed of the yarn.
The "Positorq II" spindle is a friction spindle manufactured by the company SCRAGG AND SONS LTD.

The properties of the textured yarns are given in table VI.

TABLE VI

| Examples | Yarn according to the invention | Comparative POY yarn |
|---|---|---|
| Count cN/tex | 17.5 | 21 |
| Breaking force (cN) | 67 | 77 |
| Tenacity cN/tex | 36.5 | 37 |
| Elongation % | 25 | 30 |

The properties of hose knitted using the two yarns produced are collated in table VII.

TABLE VII

| Examples | Hose obtained from yarns according to the invention | Hose obtained from comparative POY yarns |
|---|---|---|
| Elasticity % | 342 | 297 |
| Elastic recovery % | 52 | 50.3 |
| Deformation % | 128 | 123 |

An appreciable improvement in the elasticity and the elastic recovery is observed; as for the deformation, the values obtained are considered by the expert to be practically equivalent.

The yarn according to the invention produced no problems when textured; furthermore, the textured winding unwinds well.

EXAMPLES 6, 7 AND 8 (COMPARATIVE)

A polyhexamethylene adipamide matted with 0.3% by weight of titanium oxide, protected against the light with 7 ppm of manganese and having a relative viscosity of 39 is prepared.

The polymer is melted at 291° C. and extruded through a die having 30 orifices 0.40 mm in diameter.

At the exit of the die, the filaments are cooled with moist air (75% moisture) by means of a blower emitting air transversely.

The other test conditions are collated in table VIII.

TABLE VIII

| Examples | 6 | 7 | 8 comparative |
|---|---|---|---|
| Blower: air speed (m/min) | 71 | 73 | 65 |
| Distance die/convergence (cm) | 70 | 76 | 66 |
| Distance convergence/winder (cm) | 116 | 100 | 534 |
| Distance die/winder (cm) | 176 | 176 | 500 |
| Distance blower/convergence (cm) | 25 | 7.3 | 25 |
| Interlacing by nozzle before the winder | yes | yes | yes |
| Air pressure in the nozzle (Pa) | $3.5 \cdot 10^5$ | $3.5 \cdot 10^5$ | $3.5 \cdot 10^5$ |
| Tension under the convergence | | | |
| (cN) | 13 | 13 | 13 |
| (cN/dtex) | (0.20) | (0.21) | (0.20) |
| Tension before winder | | | |
| (cN) | 13 | 13 | 24 |
| (cN/dtex) | (0.200) | (0.21) | (0.37) |
| Winding speed (m/min) | 5,250 | 4,200 | 5,250 |

The yarns obtained have the properties collated in table IX.

TABLE IX

| Examples | 6 | 7 | 8 |
|---|---|---|---|
| Count (dtex) | 64.7 | 62.85 | 65 |
| Breaking force (cN) | 176.1 | 172.05 | 178.8 |
| Tenacity (cN/tex) | 27.2 | 27.4 | 27.5 |

TABLE IX-continued

| Examples | 6 | 7 | 8 |
|---|---|---|---|
| Elongation (%) | 65.8 | 79.5 | 63.1 |
| Young's modulus (cN/tex) | 162 | 150 | 170 |
| BW shrinkage (%) | 3.95 | 3.30 | 4.30 |
| U (%) | 1 | 1 | 0.8 |
| Cohesion factor | 23.13 | 16.78 | 15,69 |

In relation to a conventional process (comparative example 8) it is found that substantially identical properties can be obtained for a smaller space requirement and that the tensions in the winding zone are greatly lowered in the process according to the invention. These low tensions are necessary for producing acceptable windings. In fact, under the conditions of a high winding tension, according to example 8, it is difficult, or even impossible, to produce windings of a normal size having good appearance and having good cleanness and good unwinding characteristics. In addition to other defects, these windings have excessive hardness, and hooping effects begin to occur.

In all the above examples the winding was carried out by means of conventional winders, that is to say free from tension regulating devices.

What is claimed is:

1. A process for spinning, at high speed, filaments based on polyhexamethylene adipamide with direct take-up of the filaments on a winder at high speed, comprising mounting a plurality of dies in parallel, each of said dies containing an entrance and exit, said exit containing a plurality of orifices;

passing polyhexamethylene adipamide through said orifices of each of said dies to form a bundle of yarns for each of said dies;

cooling each of said bundle of yarns at the exit of each die by transversely blowing a gaseous fluid across each said bundle of yarns, said fluid having a moisture content of approximately 75 percent;

simultaneously bringing together and oiling the bundles of yarns at a conversion point situated at a distance of between 55 and 70 cm from each die;

providing a number of winders vertically or horizontally offset relative to each other, and passing said yarns through a small angle relative to each die so as to be wound by said winders;

depositing and winding said yarn at a speed equal to or greater than 5,000 m/min at a maximum tension of 0.21 cN/dtex, wherein the maximum distance between the die and the point of deposition of the filaments on a winding bobbin on said winder being between 130 and 200 cm.

2. A process for spinning, at high speed, filaments based on polyhexamethylene adipamide with direct take-up of the filaments on a winder at high speed, wherein the filaments are:

cooled at the exit of a die by means of a gaseous fluid blown transversely across the filaments, said fluid having a moisture content of approximately 75%, brought together and oiled simultaneously at a convergence point situated at a distance of between 55 and 70 cm from the die, deposited on a winding bobbin and wound at a speed equal to or greater than 5,000 m/min at a maximum tension of 0.21 cN/dtex, wherein the maximum distance between the die and the point of deposition of the filaments on the winding bobbin being between 130 and 200 cm.

3. A process according to claim 2, wherein the filaments are interlaced between the convergence point and the winding.

* * * * *